United States Patent [19]

Budzich

[11] Patent Number: 4,488,474

[45] Date of Patent: Dec. 18, 1984

[54] FULLY COMPENSATED FLUID CONTROL VALVE

[75] Inventor: Tadeusz Budzich, Moreland Hills, Ohio

[73] Assignee: Caterpillar Tractor Co., Peoria, Ill.

[21] Appl. No.: 458,508

[22] Filed: Jan. 17, 1983

[51] Int. Cl.[3] ..... F15B 13/02

[52] U.S. Cl. ..... 91/446; 137/596.1; 137/596.13

[58] Field of Search ..... 91/446; 137/596.1, 596.13

[56] References Cited

U.S. PATENT DOCUMENTS 4,285,195 8/1981 Budzich ..... 137/596.13 X

*Primary Examiner*—Gerald A. Michalsky

*Attorney, Agent, or Firm*—J. W. Burrows

[57] ABSTRACT

A direction flow control valve for control of positive and negative loads equipped with positive and negative load compensators, a single pilot valve stage responsive to positive and negative load pressure signals and control signal diverting valve operable to connect the pilot valve stage either to positive or negative load compensator in response to the type of load being controlled.

12 Claims, 1 Drawing Figure

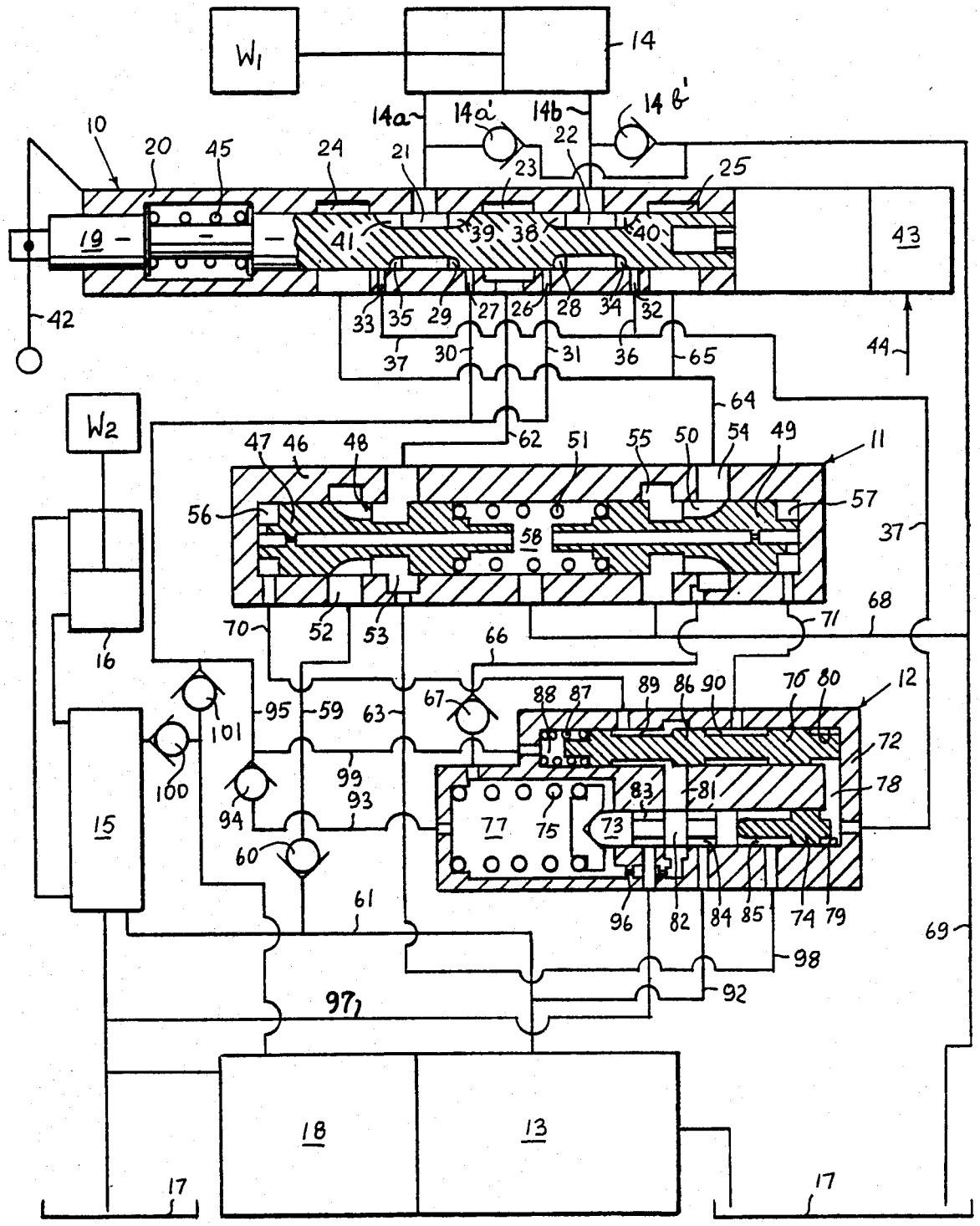
W1
14
14a
14a'
14b
14b'
10
20
45
24
21
23
22
25
19
41
39
38
40
43
42
33
35
29
27
26
28
34
32
37
30
31
36
65
44
64
W2
47
46
48
62
51
55
50
54
49
11
56
58
57
37
70
52
53
66
71
68
16
101
95
59
63
67
88
87
89
86
90
76
80
12
100
99
93
94
72
78
15
77
75
73
83
81
60
61
96
82
84
85
74
79
69
98
92
97
18
13
17
17

FULLY COMPENSATED FLUID CONTROL VALVE

BACKGROUND OF THE INVENTION

This invention relates generally to fluid control valves provided with positive and negative load compensation.

In more particular aspects this invention relates to direction and flow control valves utilizing power amplifying pilot valve stage in control of pressure throttling compensating valves.

In still more particular aspects this invention relates to pressure compensated direction and flow control valves, the individual positive and negative compensators of which are controlled by a single signal amplifying pilot valve stage.

Closed center fluid control valves, pressure compensated for control of positive and negative loads, are desirable for a number of reasons. They permit load control with reduced power losses and therefore increased system efficiency. They also permit simultaneous proportional control of multiple positive and negative loads. Such a two stage pilot operated fluid control valve is shown in my patent 4,362,087, issued Dec. 12, 1982. However, this valve uses a single compensator in control of positive and negative loads, which by necessity has a longer control stroke and comparatively large mass.

SUMMARY OF THE INVENTION

It is therefore a principal object of this invention to provide an improved pressure compensated valve, equipped for positive and negative load compensation, in which the positive and negative load compensators are controlled by a pilot valve stage.

Another object of this invention is to provide a single signal amplifying pilot valve stage, capable of controlling individual positive and negative load compensators.

It is a further object of this invention to provide a single signal amplifying pilot valve stage using the energy derived from the pump, control signal of which is diverted to a positive or negative load compensator in response to the type of load being controlled, so that the response of individual compensators can be greatly increased.

Briefly the foregoing and other additional objects and advantages of this invention are accomplished by providing a novel pressure compensated fluid control system, for use during proportional simultaneous control of multiple positive and negative loads. The pressure compensators of flow control valves of such a system are controlled by diverting the control signal from single signal amplifying pilot valve to individual compensators, in response to the type of load being controlled. Such control of individual compensators results in improved stability and higher response.

Additional objects of this invention will become apparent when referring to the preferred embodiment of the invention as shown in the accompanying drawing and described in the following detailed specification.

DESCRIPTION OF THE DRAWING

The drawing is a longitudinal sectional view of the direction control valve also showing additional longitudinal sectional views of the throttling compensators assembly and an embodiment of a pilot valve amplifying stage with system lines, second flow control valve, system actuator, system pump and system reservoir shown diagrammatically.

DESCRIPTION OF THE PREFERRED EMBODIMENT

A valve assembly composed of a direction control valve section, generally designated as 10, a compensator assembly, generally designated as 11 and a pilot valve assembly, generally designated as 12, is interposed between a pump 13 and a fluid motor 14. An identical valve assembly 15, controlling a fluid motor 16 is phased into the same control circuit. The pump 13, functionally connected to a reservoir 17, is provided with an output flow control 18. If the pump 13 is of a variable displacement type the output flow control 18 becomes a differential pressure compensator, which, in a well known manner, varies the displacement of the pump 13, to maintain a constant pressure differential between the pump discharge pressure and the load pressure, developed in the fluid motor 14 by a load $W_1$. If the pump 13 is of a fixed displacement type the output of flow control 18 becomes a differential bypass valve, which, in a well known manner, varies the bypass flow, to maintain a constant pressure differential between the pump discharge pressure and the load pressure, developed in the fluid motor 14. If the load $W_1$ and $W_2$ are simultaneously controlled, in a well known manner, the pump control 18 will automatically maintain a constant pressure differential between pump discharge pressure and the higher of the two load pressures.

The direction control valve section 10 is of a conventional configuration and in response to the displacement of its spool 19, in respect to a housing 20, sequentially connects load chamber 21 or 22 with an inlet chamber 23, or outlet chamber 24 or 25. Positive load sensing ports 26 and 27 cooperate with signal slots 28 and 29 in transmittal of the positive load pressure signal to lines 30 and 31. Negative load sensing ports 32 and 33 cooperate with signal slots 34 and 35 in transmittal of the negative load pressure signal to lines 36 and 37. Positive load metering slots 38 and 39 and the negative load metering slots 40 and 41, with the displacement of the spool 19, form variable metering orifices between the load chambers 21 and 22, the inlet chamber 23 and the outlet chamber 24 or 25. The displacement of the spool 19, resulting from displacement of a control lever 42, or displacement of conventional hydraulic actuator 43, in response to a control signal 44, is resisted by a centering spring 45. Lines 14*a* and 14*b*, transmitting the fluid flow between the direction control valve section 10 and the fluid motor 14, communicate through check valves 14*a*′ and 14*b*′ with the system reservoir 17.

The compensator assembly 11 includes a housing 46, a positive load compensator 47, with its throttling slots 48, a negative load compensator 49, with its throttling slots 50 and a control spring 51. The housing 46 is provided with an inlet core 52, a supply core 53, an outlet core 54, an exhaust core 55, control spaces 56 and 57 and exhaust space 58. The inlet core 52 is connected by line 59 and a load check 60 with the outlet line 61 of the pump 13. The supply core 53 is connected by line 62 with the inlet chamber 23 and by line 63 with the pilot valve assembly 12. The outlet core 54 is connected by lines 64 and 65 with outlet chambers 24 and 25 and by line 66 and check valve 67 with the pilot valve assembly 12. The exhaust core 55 and exhaust space 58 are connected by lines 68 and 69 with the system reservoir 17. Control spaces 56 and 57 are connected by lines 70 and 71 with the pilot valve assembly 12.

The pilot valve assembly 12 includes a housing 72, a pilot valve spool 73, a free floating piston 74, a control spring 75 and a shuttle spool 76. The housing 72 is provided with control chambers 77 and 78, pilot bore 79, shuttle bore 80 and control port 81. The pilot valve spool, provided with a metering land 82, defines spaces 83, 84 and 85, in respect to bore 79. The shuttle spool 76, provided with shuttle land 86 and spring 87, defines spaces 88, 89 and 90 in respect to bore 80. Space 84 is connected by line 92 to outlet line 61. Control space 77 is connected by line 93, check valve 94 and line 95 to the positive load sensing ports 27 and 26, while also being connected through leakage orifice 96 and line 97 to the system reservoir 17. Space 85 is connected by line 98 with the supply core 53. Space 88 is connected by line 99 with positive load sensing ports 26 and 27. The positive load signals from the direction control valve section 10 and from the valve assembly 15 are transmitted through the logic system of check valves 100 and 101 and line 102 to the output flow control 18.

Assume that valve assembly 15 is controlling a positive load $W_2$, which is higher than load $W_1$, with discharge pressure of the pump 13 being maintained higher, by a constant pressure differential, than that equivalent to load pressure due to the load $W_2$. Pump discharge pressure, transmitted through lines 61 and 59, the inlet core 52, throttling slots 48, the supply core 53 and line 98 to space 85, will react on the cross-sectional area of pilot spool 73 and move it from right to left, against the biasing force of the control spring 75, connecting space 84, through the control port 81, space 89 and line 70, with control space 56. The positive load compensator 47 will be moved by the pressure in control space 56, against the biasing force of the control spring 51, to a position, in which, by throttling action of throttling slots 48, it will maintain the supply chamber 53 at a pressure level high enough for modulating action of the pilot valve 73. This condition of equilibrium will be maintained during control of the positive load $W_2$.

Assume that while the positive load $W_2$ is being controlled by the valve assembly 15 the spool 19 is moved either by the control lever 42, or the hydraulic actuator 43, from left to right, to a position, in which signal slot 29 connects the load chamber 21 with the positive load sensing port 27. Such displacement of the spool 19 also connects the load chamber 22, through signal slot 34, with the negative load sensing port 32. Assume also that the load $W_1$ is positive and that it is smaller than the positive load $W_2$. The positive load pressure signal will then be transmitted from the positive load sensing port 27 to space 88 and the control chamber 77. The pilot valve 73 will respond, in a well known manner, by changing its modulating position, to maintain the pressure in the supply chamber 53 and in space 85 higher, by a constant pressure differential, equivalent to the preload in the control spring 75, than the pressure in the load chamber 21. Simultaneously the negative load pressure, at the exhaust pressure level, will be transmitted from the negative load sensing port 32 to the control chamber 78. The free floating piston 74, subjected to pressure differential between space 85 and the control chamber 78, will move out of contact with the pilot spool 73 all the way to the right and the shuttle spool 76 will be maintained, in the position as shown, by the pressure differential developed across it and by the biasing force of the spring 87.

Assume that the spool 19 is further displaced from left to right, creating a metering orifice through the positive load metering slot 39, between the inlet chamber 23 and the load chamber 21, while the load chamber 22 is being connected by the negative load metering slot 40 with the outlet chamber 25. The pilot spool 73 will move into a new modulating position controlling the throttling action of the positive load compensator 47, to maintain a constant pressure differential between the inlet chamber 23 and the load chamber 21 and across newly created metering orifice between those two chambers, through which a controlled fluid flow is now taking place. This constant pressure differential will be maintained by the positive load compensator 47, controlled by the action of the pilot valve 73, irrespective of the change in the area of metering orifice, or the change in the magnitude of the load $W_1$.

Assume that the load $W_1$ becomes negative. The pressure transmitted from the positive load sensing port 27 to the control chamber 77 and space 88 will drop to the exhaust level, the check valve 94 will close, the check valve 67 will open and the control chamber 77 will be directly connected, through line 66, with the outlet core 54. The negative load pressure will be transmitted from the negative load sensing port 32, through line 37, to the control chamber 78. Subjected to the pressure differential the shuttle spool 76 will move from right to left, connecting through space 90 and line 71 the control port 81 with control space 57. Subjected to pressure differential the free floating piston 74 will come in contact with the pilot spool 73, which then becomes subjected on one end to the negative load pressure and on the other end to the pressure in the outlet core 54 and the biasing force of the control spring 75. Subjected to those forces the pilot valve assembly, consisting of pilot spool 73 and free floating piston 74, will assume a modulating position, to control the throttling action of the negative load compensator 49, in order to maintain a constant pressure differential between the load chamber 22 and the outlet chamber 25 and across the metering orifice created by displacement of the negative load metering slot 40.

The change of load $W_1$ from positive or negative and vice versa, while its position is being controlled by the load sensing control valve, as shown in the drawing, will automatically change the polarity of the load sensing ports and therefore the position of the shuttle spool 76 connecting, depending on the characteristics of load $W_1$, the pilot valve assembly 12 either with the positive load compensator 47, or the negative load compensator 49. When controlling a positive load the pilot spool 73 is subjected to pressure differential acting across the positive load metering orifice and when controlling a negative load the pilot spool 73, through the action of the free floating piston, is subjected to pressure differential, acting across the negative load metering orifice. In this way individual positive and negative load compensators can be controlled by a single signal amplifying pilot valve assembly.

Although the preferred embodiment of this invention has been shown and described in detail it is recognized that the invention is not limited to the precise form and structure shown and various modifications and rearrangements as will occur to those skilled in the art upon full comprehension of this invention may be resorted to without departing from the scope of the invention as defined in the claims.

What is claimed is:

1. A valve assembly comprising a housing having an inlet chamber connected to a pump and an outlet chamber connected to exhaust means, first means operable to selectively communicate said inlet and said outlet chambers with a fluid motor, first control orifice means interposed between said inlet chamber and said fluid motor, second control orifice means interposed between said fluid motor and said exhaust means, positive load fluid throttling means between said inlet chamber and said pump, and negative load fluid throttling means between said outlet chamber and said exhaust means, said positive and said negative load fluid throttling means controllable by a fluid power amplifying and control means, and control signal diverting means interposed between said fluid power amplifying and control means and said positive and negative load fluid throttling means, said fluid power amplifying and control means operable to (i) throttle fluid flow by said positive load fluid throttling means to maintain a relatively constant pressure differential across said first control orifice means and (ii) to throttle fluid flow by said negative load fluid throttling means to maintain a relatively constant pressure differential across said second control orifice means.

2. A valve assembly as set forth in claim 1 wherein said fluid power amplifying and control means include pilot amplifying valve means.

3. A valve assembly as set forth in claim 2 wherein said pilot amplifying valve means has first control force generating means responsive to pressure differential across said first control orifice means and second control force generating means responsive to pressure differential across said second control orifice means.

4. A valve assembly as set forth in claim 1 wherein said valve assembly has positive load pressure sensing means in said housing selectively communicable with positive load pressure in said fluid motor by said first means.

5. A valve assembly as set forth in claim 4 wherein said positive load pressure sensing means has means communicable with said fluid power amplifying and control means and means operable to transmit positive load pressure signal to said pump.

6. A valve assembly as set forth in claim 4 wherein said control signal diverting means has first actuating means responsive to pressure in said positive load pressure sensing means.

7. A valve assembly as set forth in claim 1 wherein said valve assembly has negative load pressure sensing means in said housing selectively communicable with negative load pressure in said fluid motor by said first means.

8. A valve assembly as set forth in claim 7 wherein said fluid power amplifying and control means includes free floating piston means having means responsive to pressure in said negative load pressure sensing means.

9. A valve assembly as set forth in claim 7 wherein said control signal diverting means has first actuating means responsive to pressure in positive load pressure sensing means and second actuating means responsive to pressure in said negative load sensing means.

10. A valve assembly as set forth in claim 1 wherein said positive load fluid throttling means has means responsive to a control pressure signal generated by said fluid power amplifying and control means.

11. A valve assembly as set forth in claim 1 wherein said negative load fluid throttling means has means responsive to a control pressure signal generated by said fluid power amplifying and control means.

12. A valve assembly as set forth in claim 1 wherein said control signal diverting means has shuttle valve means operable to interconnect said fluid power amplifying and control means with said positive load fluid throttling means when said fluid motor is subjected to a positive load and to interconnect said fluid power amplifying and control means with said negative load fluid throttling means when said fluid motor is subjected to a negative load.

* * * * *